US009050504B2

(12) United States Patent
Leveille

(10) Patent No.: US 9,050,504 B2
(45) Date of Patent: Jun. 9, 2015

(54) PROCESS FOR PRODUCING A WAX IMPREGNATED MESH POCKET FOR A LACROSSE STICK

(75) Inventor: Marc Yvon Leveille, Burlington (CA)

(73) Assignee: BLUE COLLAR LACROSSE INC., Oakville, Ontario (CA)

( * ) Notice: Subject to any disclaimer, the term of this patent is extended or adjusted under 35 U.S.C. 154(b) by 131 days.

(21) Appl. No.: 12/891,577

(22) Filed: Sep. 27, 2010

(65) Prior Publication Data

US 2011/0010914 A1 Jan. 20, 2011

Related U.S. Application Data

(62) Division of application No. 12/103,343, filed on Apr. 15, 2008, now abandoned.

(51) Int. Cl.

| | |
|---|---|
| ***B05D 3/02*** | (2006.01) |
| ***A63B 59/02*** | (2006.01) |
| ***D06M 13/02*** | (2006.01) |
| *A63B 51/02* | (2006.01) |
| *A63B 59/00* | (2006.01) |

(52) U.S. Cl.

CPC ..... *A63B 59/02* (2013.01); *Y10T 29/49826* (2015.01); *Y10T 428/2481* (2015.01); *A63B 51/02* (2013.01); *A63B 59/0088* (2013.01); *D06M 13/02* (2013.01); *D06M 2200/40* (2013.01)

(58) Field of Classification Search

CPC .... A63B 59/02; A63B 51/02; A63B 59/0088; Y10T 29/49826; Y10T 428/2481; D06M 13/02; D06M 2200/40

USPC ..... 427/394; 442/1, 58

See application file for complete search history.

(56) References Cited

U.S. PATENT DOCUMENTS

| | | | | |
|---|---|---|---|---|
| 1,967,267 | A * | 7/1934 | Serrington | 442/84 |
| 2,753,677 | A | 7/1956 | Slayter | |
| 4,308,633 | A | 1/1982 | Van Huffel et al. | |
| 4,963,045 | A * | 10/1990 | Willcox | 401/132 |
| 5,306,534 | A | 4/1994 | Bosses | |
| 5,716,662 | A | 2/1998 | Fitzburgh | |
| 6,156,086 | A | 12/2000 | Zhang | |
| 6,821,303 | B2 | 11/2004 | Polsky | |
| 6,986,915 | B2 | 1/2006 | Bourdages | |
| 7,192,369 | B2 | 3/2007 | Morrow | |
| 7,278,936 | B2 | 10/2007 | Tucker | |
| 2006/0258488 | A1 | 11/2006 | Lamson et al. | |
| 2007/0010357 | A1 | 1/2007 | Matthew | |

OTHER PUBLICATIONS

Stick Tech Workshop Reader Tips XII available online as of Jan. 22, 2003.*

* cited by examiner

*Primary Examiner* — Robert S Walters, Jr.

(74) *Attorney, Agent, or Firm* — Philip C. Mendes da Costa; Bereskin & Parr LLP/S.E.N.C.R.L., s.r.l.

(57) ABSTRACT

A mesh pocket for a lacrosse stick is disclosed. The mesh pocket is defined by a plurality of strands, which are interengaged. A wax is impregnated into at least a portion of at least some of the strands. Additionally, a process for applying a wax to a mesh of a lacrosse stick is disclosed. The process comprises providing a wax-permeable layer having a first and second opposed sides, and positioning the first side in contact with the mesh. The process further comprises providing molten wax to the second opposed side of the wax-permeable layer. The molten wax passes through the wax-permeable layer to the mesh.

7 Claims, 6 Drawing Sheets

PROCESS FOR PRODUCING A WAX IMPREGNATED MESH POCKET FOR A LACROSSE STICK

CROSS REFERENCE TO THE RELATED APPLICATION

This application is a divisional of co-pending U.S. application Ser. No. 12/103,343, filed on Apr. 15, 2008, which is herein incorporated by reference.

FIELD OF THE INVENTION

The invention relates to mesh pockets for lacrosse sticks. More specifically, the invention relates to mesh pockets, which are treated with wax. Additionally, the invention relates to a method for applying wax to a mesh of a lacrosse stick.

BACKGROUND OF THE INVENTION

Typically, a lacrosse stick includes a shaft and a head. The head has attached thereto a plurality of strands that are inter-engaged to define a pocket, which is supported within a frame. In use, the shaft is gripped by the user, and the mesh pocket cups and supports a ball.

Typically, nylon and leather are used to construct the pocket. A leather pocket has leather runners that are fixed at the top and bottom of the frame. The leather runners are joined to the side of the frame by a nylon rope that is woven to form a net or mesh for the ball to sit on. The runners are advantageous as they allow the ball to leave the pocket at a relatively high velocity and a high degree of accuracy. One disadvantage of such a construction is that the leather runners are extremely water absorbent and will stretch when wet. Further, when the leather dries, the leather will shrink, which may occur unevenly.

Two types of nylon mesh are used, namely a hard mesh and a soft mesh. A hard mesh allows the ball to leave the stick at a relatively high velocity, similar to that of a mesh with leather runners. However, the mesh has very little give. Accordingly, it is hard to catch passes and carry the ball in the mesh while running. Further, the ball has a tendency to pop out of the pocket when the stick is checked.

A hard mesh is obtained by coating nylon with a liquid rope whipping agent, a stiffening agent. For example, United States patent application publication 2006/0258488 to Lamson discloses coating the mesh with polyurethane elastomer, polyester, vinyl, polyvinylidene fluoride, polypropylene, EVA, ionomer, thermoplastic urethane, and polyamide. According to Lamson, such stiffening agents allow the user to throw the ball faster and with more accuracy. However, the use of stiffening agents may also reduce the ease with which a user may carry or hold the ball in the mesh. Accordingly, U.S. Pat. No. 7,278,936 to Tucker discloses coating only a portion of the mesh with a stiffening agent, such that the ball may be held in the coated portion when the user is throwing the ball, and in the non-coated portion when a user is carrying the ball. In the disclosure of Tucker, the stiffening agent is applied to the stick by spraying, painting, or dipping.

A soft mesh, an nylon that is not coated with a liquid rope whipping agent, has superior cushioning and holding characteristics, thereby producing a pocket that is better for catching passes, carrying the ball while running and picking up a ball. However, the mesh tends to grip the ball as it is shot, which may result in the ball having a relatively slower velocity and reduced accuracy.

Several methods are known for applying a wax to a substrate such as a fabric or a surface. For example, U.S. Pat. No. 4,308,633 to Van Huffel et al. discloses a method of applying a wax to a surface such as the bottoms of skis. The method includes providing a carrier sheet that is loaded with wax and is substantially impervious to the passage of melted wax therethrough. The carrier sheet is applied to the surface and heated to melt the wax and deposit it on the skis. U.S. Pat. No. 6,821,303 to Polsky discloses a method of applying a wax to a cloth material for creating Batik art. The method involves applying a carrier sheet, which is loaded with wax, to the cloth, and applying pressure to the carrier sheet to deposit the wax onto the cloth.

SUMMARY OF THE INVENTION

In one broad aspect, a mesh pocket for a lacrosse stick is provided. The mesh pocket is defined by a plurality of strands, which are inter-engaged. A wax is impregnated into at least a portion of at least some of the strands. If the material of the strands is able to absorb wax, then the wax may be absorbed into the material of the strands themselves. Alternately, and preferably, the strands are made from a synthetic material, e.g., nylon, which is not permeable to wax. In such a case, the stands may be made from a plurality of elongate members and the wax may be impregnated into the strands by being deposited in the interstitial spaces between adjacent elongate members.

Embodiments in accordance with this broad aspect are advantageous because the wax provides the ability to throw a ball with speed and accuracy, and also allows the ball to be held and carried with ease.

Additionally, embodiments in accordance with this broad aspect are advantageous as the wax provides water resistance to the strands. That is, the wax reduces the amount of water that is absorbed into the strands. This in turn reduces the amount that the strands stretch when the stick is used.

Additionally, embodiments in accordance with this broad aspect are advantageous because the wax allows the pocket to retain its shape.

In some embodiments, each strand comprises a plurality of elongate members, and the wax is positioned between the elongate members. Such embodiments may be advantageous because the wax may provide increased durability to the strands.

In some embodiments, the wax is at least one of a petroleum wax, a vegetable wax, a mineral wax, an animal wax, a synthetic wax, and a combination thereof. In some further embodiments, the wax is a paraffin wax.

In some embodiments, the elongate members comprise nylon.

In some embodiments, the wax is applied as a liquid to the mesh pocket. Such embodiments may be advantageous because the wax may penetrate deeply into the strands.

In some embodiments, at least some of the strands are at least partially colored strands and the wax is positioned on the colored portions of the strands. Such embodiments may be advantageous because the wax may be applied to permit one or more distinct portions of the mesh.

In some embodiments, the mesh pocket has a plurality of openings between adjacent strands and the openings have an absence of wax.

In some embodiments, the wax is impregnated into an entire portion of all of the strands.

In some embodiments, the wax is impregnated into all portions of all of the strands.

In another broad aspect, a process for applying a wax to a mesh of a lacrosse stick is provided. The process comprises providing a wax-permeable layer having first and second opposed sides, and positioning the first side in contact with the mesh. The process further comprises providing molten wax to the second opposed side of the wax-permeable layer. The molten wax passes through the wax-permeable layer to the mesh.

Embodiments in accordance with this broad aspect may be advantageous because the process may allow for the wax to be impregnated into the mesh without filing the openings in the mesh.

In some embodiments, the process further comprises selecting a porous substrate as the wax-permeable layer.

In some embodiments, the step of providing the molten wax comprises pouring the molten wax onto the wax-permeable layer, and allowing the molten wax to pass through the wax-permeable layer to the mesh.

In some embodiments, the process further comprises heating the mesh while providing the molten wax to the wax-permeable layer, or subsequent to providing the molten wax to the wax-permeable layer. Such embodiments may be advantageous because the wax may penetrate into the mesh without filling the openings in the mesh. In some such embodiments, the mesh is heated by applying a heated metal surface to the second opposed side of the wax-permeable layer.

In some embodiments, the process further comprises providing sufficient heat such that the wax is impregnated into the mesh. In some further embodiments, the mesh comprises a plurality of strands, and each strand comprises a plurality of elongate members, and sufficient heat is provided such that the wax flows between the elongate members.

In some embodiments, the molten wax passes through the wax-permeable layer to a first portion of the mesh, and the method further comprises applying a colorant, e.g., and ink or dye, to a second portion of the mesh adjacent the first portion of the mesh, and subsequently providing molten wax to the second opposed side of the wax-permeable layer, whereby the molten wax passes through the wax permeable layer to the second portion of the mesh. Such embodiments may be advantageous because color may be provided to the mesh in various colors and patterns, and the wax may aid in preventing the colors from bleeding into adjacent portions of the mesh.

BRIEF DESCRIPTION OF THE DRAWINGS

These and other advantages of the present invention will be more fully and particularly understood in connection with the following description of the preferred embodiments of the invention in which.

DETAILED DESCRIPTION OF THE INVENTION

Figure 1:
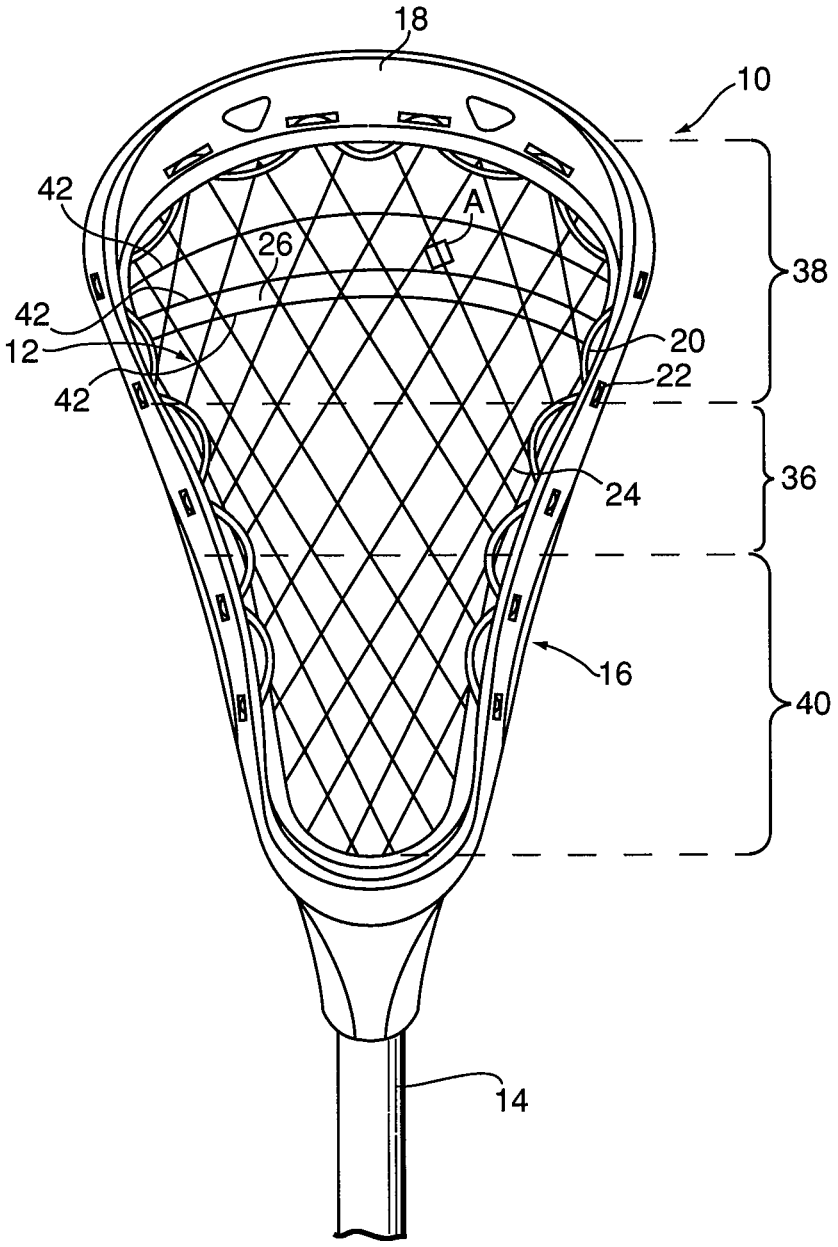
FIG. 1 is a front plan view of a lacrosse stick comprising a mesh pocket of the present invention.

Referring to FIG. 1, a lacrosse stick 10 comprising an embodiment of a mesh pocket 12 of the present invention is shown. Lacrosse stick 10 comprises a shaft 14 and a head 16. Head 16 comprises a frame 18, which supports mesh pocket 12. In the embodiment shown, mesh pocket 12, is secured to frame 18 by a securing member 20, which is woven between portions of mesh pocket 12 and openings 22 provided in frame 18. In other embodiments, mesh pocket 12 may be secured to frame 18 in another manner. Lacrosse stick 10 may be of any design known in the art.

It will be appreciated that mesh pocket 12 may be provided secured to frame 18, or separately from frame 18. For example, mesh pocket 12 may be sold as a replacement pocket, to be secured onto a pre-existing frame. Furthermore, mesh pocket 12 may be pre-formed, or may be formed onto frame 18.

Mesh pocket 12 is defined by a plurality of strands 24 which are inter-engaged as is known in the art to form an expanse of mesh having openings between adjacent strands. Any construction known in the art may be used.

Figure 2A:
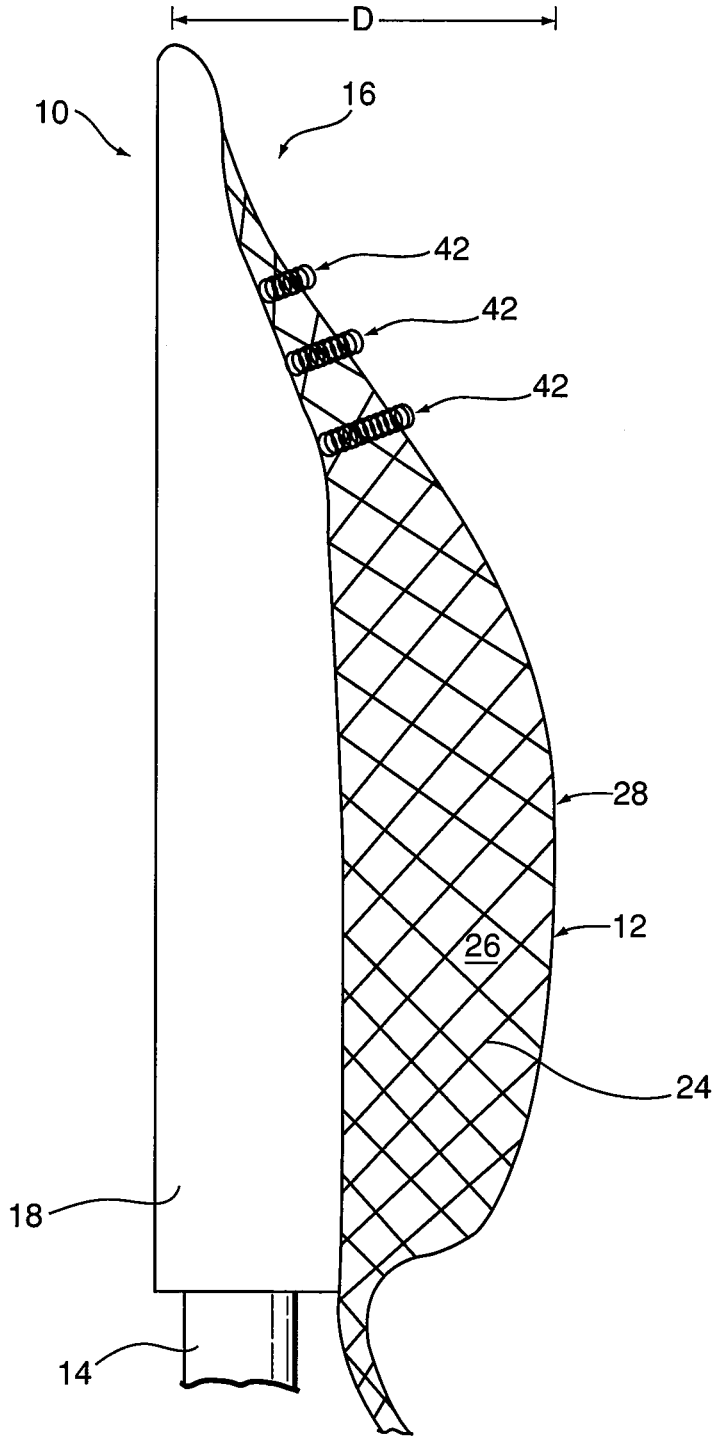
FIG. 2*a* is a side plan view of the lacrosse stick of FIG. 1 with a regular pocket.
Figure 2B:
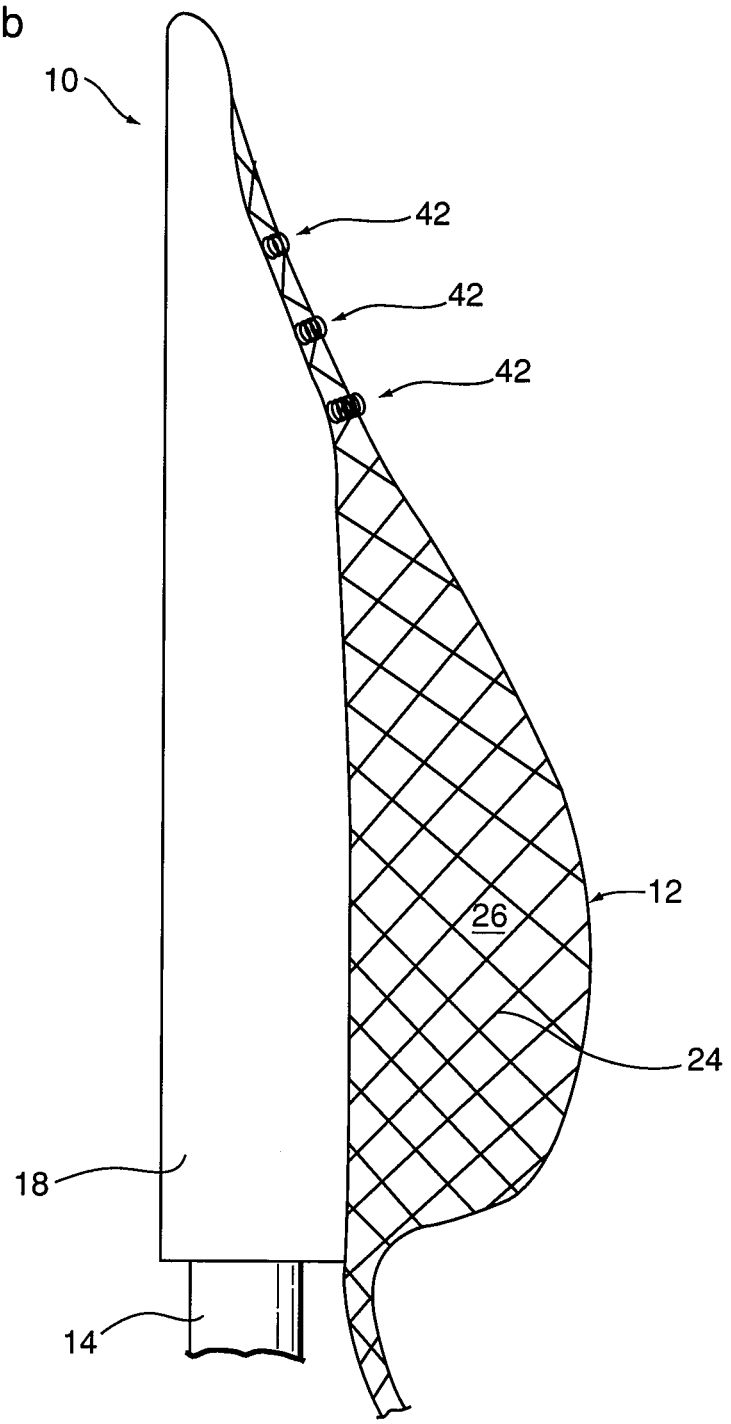
FIG. 2*b* is a side plan view of the lacrosse stick of FIG. 1 with a low pocket.
Figure 2C:
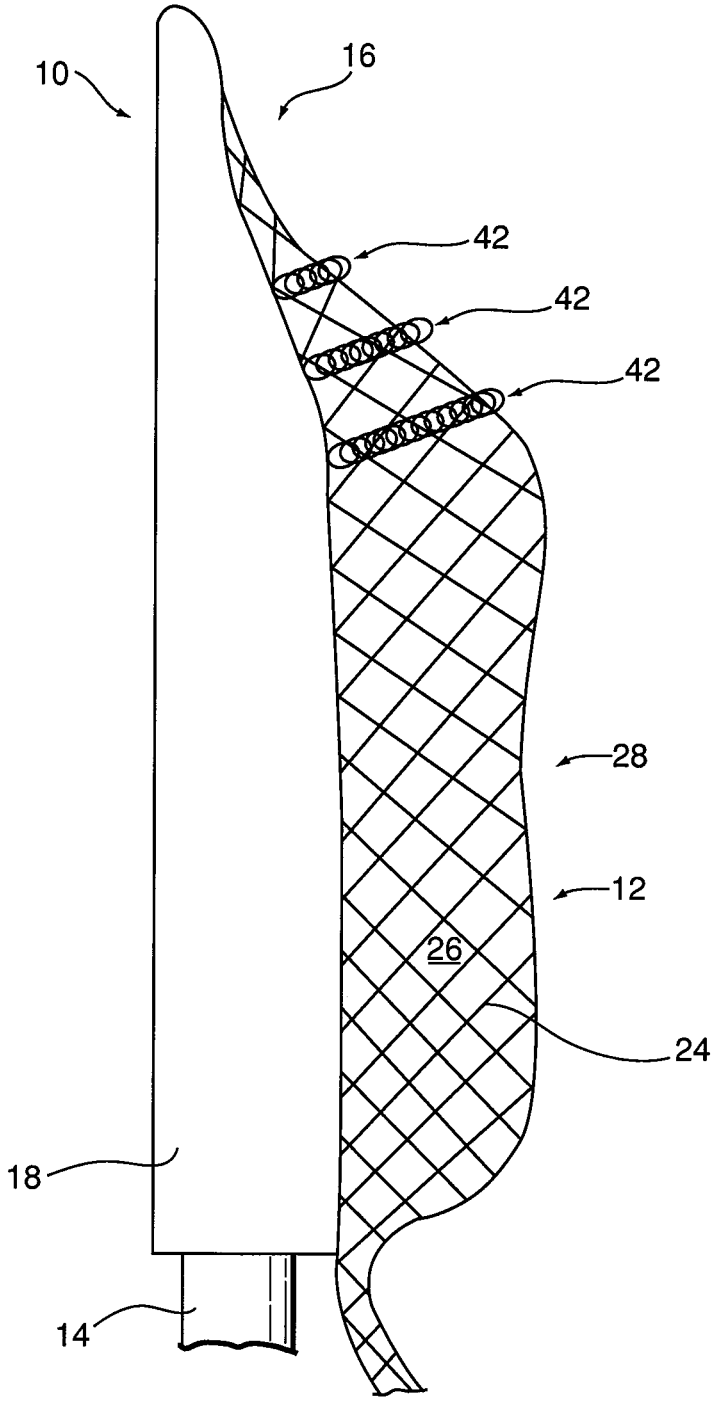
FIG. 2*c* is a side plan view of the lacrosse stick of FIG. 1 with a high pocket.

For example, strands 24 may be woven, knotted, spun, intertwined, welded, or otherwise interconnected to form mesh pocket 12. Strands 24 may be inter-engaged in a variety of configurations, to form various configurations of a mesh pocket. For example, in the embodiments shown, strands 24 are inter-engaged to form a mesh pocket having diamond-shaped openings 26. In other embodiments, openings 26 may be otherwise shaped. Furthermore, strands 24 may be inter-engaged to form a mesh pocket having a variety of depths. For example, when viewed from the side, as shown in FIGS. 2*a*-2*c*, mesh pocket 12 may have a concavity or profile 28 having a depth D. Additionally, strands 24 may be inter-engaged to form a mesh pocket 12 suitable for securing to a variety of frames of different shapes. The position of pocket 12 may be varied, such as by adjusting shooting strings 42. By tightening shooting strings 42, a regular pocket as exemplified in FIG. 2*a* may be converted to a low pocket as exemplified in FIG. 2*b*. Conversely, by loosening shooting strings 42, a regular pocket as exemplified in FIG. 2*a* may be converted to a high pocket as exemplified in FIG. 2*c*.

It will be appreciated that the plurality of strands 24 preferably comprises a plurality of distinct strands that are combined together to form the mesh.

Strands 24 may be fabricated from a variety of materials. Any material known in the lacrosse arts may be used. Such materials include, but are not limited to, nylon and polyester. Furthermore, in some embodiments, mesh pocket 12 may comprise a mixture of different materials. For example, mesh pocket 12 may comprise a plurality of nylon strands, and a plurality of polyester strands. Preferably, the strands are nylon that is not coated with a liquid rope whipping agent (a soft nylon mesh).

Figure 3:
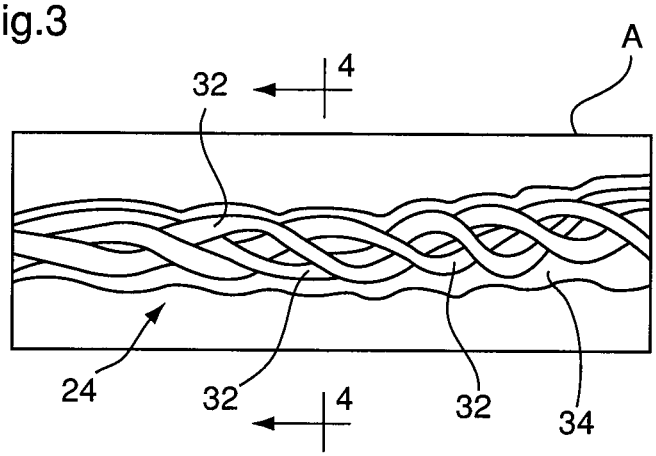
FIG. 3 is an enlarged view of area A of FIG. 1.

Preferably, in some embodiments as exemplified in FIG. 3, each strand comprises a plurality of elongate members 32. For example, a plurality of nylon elongate members 32 may be spun, woven or braided together to form a nylon strand 24. It will be appreciated that each elongate member 32 may itself be formed of a plurality of members that are spun, woven or braided together.

Figure 4:
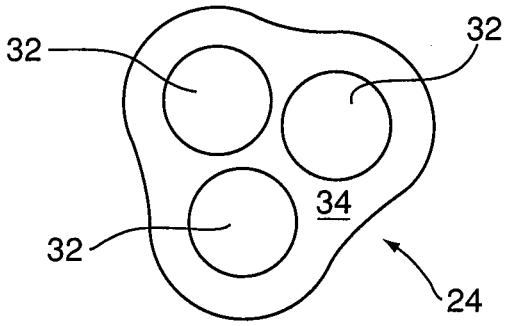
FIG. 4 is a cross-section taken along line 4-4 in FIG. 3.

Referring to FIG. 4, a wax 34 is impregnated into at least a portion of at least some of the strands. Preferably, the wax is impregnated into at least a portion of all of the strands. More preferably, the wax is impregnated into all or essentially all of the strands. Accordingly, the wax essentially is provided to all of the mesh.

As used herein, the term 'impregnated' indicates that the wax penetrates beyond the surface of the strand. For example, the wax may be absorbed into the material forming the strand. Alternatively, or in addition, as exemplified in FIG. 4, the wax may penetrate into the interstitial or open space between at least some of the adjacent elongate members of the strand, such that the wax is positioned in at least a portion of the interstitial space between adjacent elongate members.

Preferably, the wax is applied to the mesh pocket as a liquid, in order to impregnate the strands, and subsequently allowed to harden, as will be further described hereinbelow. More preferably, the wax is applied in such a manner so as to not fill the openings in the mesh (i.e. the openings 26 between adjacent strands 24.

Once the wax is applied, the pocket may then be broken in, such as by using the stick to throw and catch a ball for, e.g., one hour. During this process, the wax that is applied to the mesh and is impregnated into the strands will be fractured. Some of the wax may be broken off and fall out of the mesh.

The wax serves to improve the speed and accuracy with which the ball may be thrown, and also allows the ball to be held and carried with ease. Without being limited by theory, it is believed that, once a soft mesh with wax applied thereto has been broken in, the wax that remains in the strands is sufficient to provide the mesh with a memory characteristic, similar to that of a hard mesh, permitting a shot with increased accuracy and velocity. However, at the same time, the mesh has the characteristics of a soft mesh, namely increased cushioning permitting better carrying capabilities then a hard mesh.

Additionally, the wax reduces the amount of water that is absorbed into the strands, e.g. if the stick is used outside when it is raining. For example, the amount of water that is absorbed into the strands that are impregnated with wax may be less than half than the amount of water that is absorbed into strands that are not impregnated with wax. This in turn reduces the amount that the strands stretch when the stick is used.

Furthermore, the wax allows the pocket to retain its shape. In particular, by treating a soft nylon mesh with wax, the pocket may be customized by a player. For example, the player may break in the stick to position the pocket at a location that they prefer. This may be achieved by the player breaking in the mesh, e.g., applying pressure or force to the mesh in a particular area to break, fracture or otherwise affect the wax in the mesh so that a pocket is formed in the desired location.

In some embodiments, the wax may be impregnated into only a portion of each strand. For example, in the embodiment shown in FIG. 2, wherein mesh pocket 12 comprises a concavity 28, the wax may be impregnated into the portion of the strands forming the concavity. In other embodiments, the wax may be impregnated into only some of the strands. For example, the wax may be impregnated into every other strand. Such configurations, wherein the wax is impregnated into only some strands, or only a portion of the strands, may be useful where it is desired for different portions of the mesh pocket 12 to have different properties or to be used for different purposes. However, because the wax provides the ability to throw a ball with speed and accuracy, and also allows the ball to be held and carried with ease, in the preferred embodiment, the wax is impregnated into substantially the entirety of each of the strands.

The wax may be selected from a variety waxes, including petroleum waxes, vegetable waxes, mineral waxes, animal waxes, synthetic waxes, and combinations thereof. In the preferred embodiment, the wax is a paraffin wax.

The wax may be applied to the mesh pocket in a variety of ways. Preferably, the wax is applied to the mesh through a wax permeable layer. The wax permeable layer may be a porous substrate. The substrate may be woven or non-woven and may be made from natural and/or synthetic fibers. For example, the substrate may be cheesecloth, paper towel or a woven cotton such as is used for T-shirts. Preferably the fibers are heat stable, i.e., they will not melt or burn at the temperatures used to apply the wax. Preferably, the substrate is a woven cloth.

The wax-permeable layer may be sized to cover the entire mesh, or only a portion of the mesh, as will be described further hereinbelow.

A preferred process 500 for applying the wax to the mesh will presently be described with reference to FIG. 5, however it will be appreciated that alternate processes may be used, such as dipping the mesh into molten wax.

Figure 5:
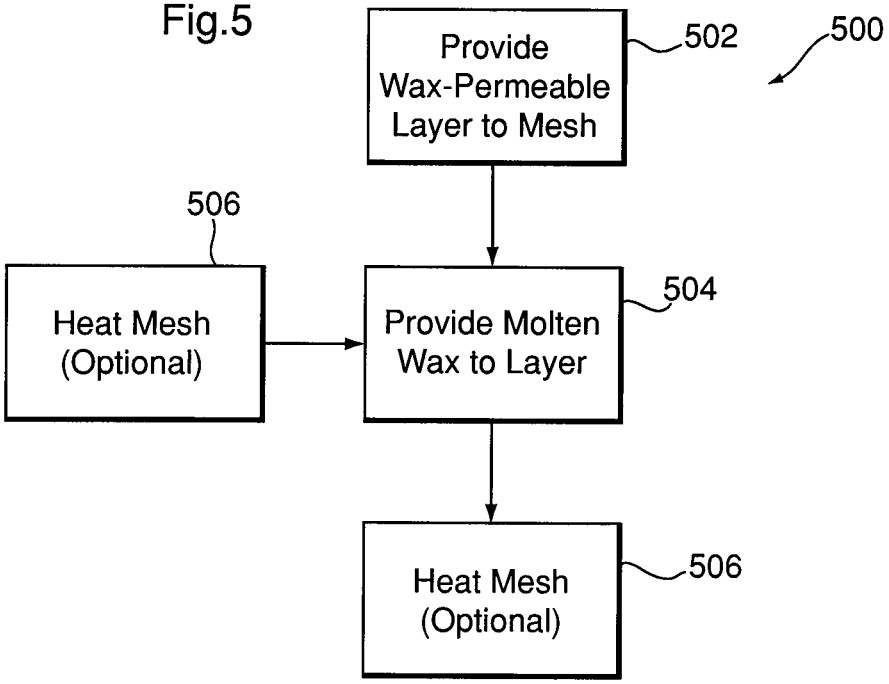
FIG. 5 is a flow-chart illustrating an embodiment of a process of the present invention; and, FIG. 6 is a flow-chart illustrating an alternate embodiment of a process of the present invention.

Referring to FIG. 5, at step 502, a wax-permeable layer is provided. The wax-permeable layer has first and second opposed sides, and is positioned such that the first side is in contact with the mesh. For example, the mesh may be laid flat on a work-surface, and the wax-permeable layer may be laid flat on top of the mesh.

At step 504, molten wax is provided to the second side of the wax-permeable layer, such that the wax must pass through the wax-permeable layer to the mesh. For example, molten wax may be poured onto the second side of the wax permeable layer, and the wax may be allowed to permeate through the wax-permeable layer to reach the mesh. Alternately, or in addition, solid wax may be provided on the wax permeable layer and the layer then heated to fluidize the wax to a sufficient degree that it will flow through the wax permeable layer to the mesh. For example, a wax layer may be provided on the wax permeable layer.

In some embodiments, at step 506, the mesh and/or the wax-permeable layer may be preheated prior to contacting the wax permeable layer to the mesh. Alternately, or in addition, the mesh and/or the wax-permeable layer may heated while providing the molten wax to the wax-permeable layer, or subsequent to providing the molten wax to the wax-permeable layer.

According to an alternate method, part or all of the mesh may be dipped into a container of molten wax. The resultant coated mesh may then be treated to remove excess wax. For example, the mesh may be placed between, e.g., two cloths, to remove excess wax (e.g., wax coated on the strands and filling any spaces 26). The excess wax may be absorbed by the clothes or may flow through the cloths as pressure is applied. Alternately, or in addition, the mesh may be heated to liquefy cooled wax, thereby enabling additional excess wax to be removed (sponged up). Further, the mesh may be heated to assist in further impregnating additional wax into the strands. The dipped mesh may be heated directly, such as by placing a heated metal surface (e.g., an iron) directly thereon or by placing a heat conductive layer between the heated surface and the mesh. Other methods of heating the coated mesh may be used to liquefy, or maintain the wax in a molten state, to permit excess wax to flow off the strands.

The mesh is optionally heated, which may be conducted in a variety of ways. In some embodiments, a heated metal surface, such as a conventional clothes iron, may be used to heat the mesh. The heated metal surface may be applied directly to the mesh, or, preferably, indirectly to the mesh. For example, the heated metal surface may be applied to the second side of the wax-permeable layer. The heat may serve to allow the wax to become impregnated into the mesh. That is, the heat may liquefy the wax and/or maintain existing molten wax in a molten form, such that it may flow between the elongate members of the strands, for example. When the mesh has been impregnated with the wax, the wax may be left to cool and harden.

In some embodiments, the wax may be provided such that the entirety of the mesh receives the wax. For example, in embodiments wherein the wax-permeable layer is sized to cover the entire mesh, the wax may be poured over the entirety of the wax permeable layer. In alternate embodiments, the wax may be provided such that only a portion of the mesh receives the wax. For example, the wax-permeable layer may be sized to cover only a portion of the mesh, and the wax may be poured only onto the wax-permeable layer, such that only the portion of the mesh underlying the wax-permeable layer receives the wax. Alternatively, the wax-permeable layer may be sized to cover the entire mesh, and the wax may be poured onto only a portion of the wax-permeable layer, such that only the portion of the mesh underlying the portion of the wax-permeable layer receives the wax.

Figure 6:
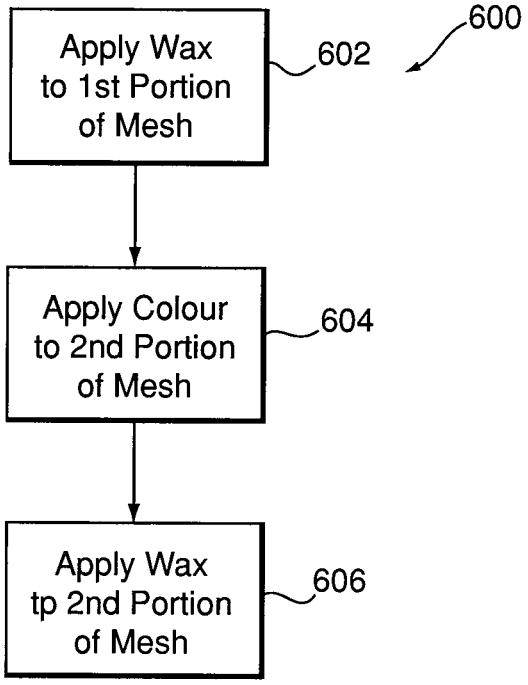

In some embodiments, the process may further involve the application of color to the mesh. The process may allow for the color to be applied in a variety of colors and patterns, and may prevent the various colors from bleeding into each other. For example, referring process 600 shown in FIG. 6, in some embodiments, it may be desired to have a mesh wherein a first portion 36 of the mesh is colorless, and one or more additional portions, e.g., second portion 38 and third portion 40 of the mesh are colored. In such an embodiment, at step 602, the wax may be applied to the first portion of the mesh as described hereinabove. At step 604, the desired color may be applied to the second portion of the mesh, for example by dipping or spraying. Because the first portion of the mesh is already impregnated with the wax, the color will not be absorbed into to the first portion of the mesh. After the color is applied to the second portion of the mesh, wax may be applied to the second portion, at step 606, as described hereinabove. Steps 604 and 606 may be repeated for a third, and additional portions of the mesh. For example, the central portion 36 of the mesh may be uncolored (e.g., white). The upper or second portion 38 may be blue and the third, or lower portion 40, may be red. It will be appreciated that, by using this process or a variation, a mesh may be color coded to those of a particular team.

It will be appreciated that any or all of the above steps may be performed either automatically, or manually. Furthermore, it will be appreciated that any or all of the above steps may be carried out while the mesh is secured to the frame, or before the mesh is secured to the frame.

It will be appreciated that certain features of the invention, which are, for clarity, described in the context of separate embodiments or separate aspects, may also be provided in combination in a single embodiment. Conversely, various features of the invention, which are, for brevity, described in the context of a single embodiment or aspect, may also be provided separately or in any suitable sub-combination.

Although the invention has been described in conjunction with specific embodiments thereof, if is evident that many alternatives, modifications and variations will be apparent to those skilled in the art. Accordingly, it is intended to embrace all such alternatives, modifications and variations that fall within the spirit and broad scope of the appended claims. In addition, citation or identification of any reference in this application shall not be construed as an admission that such reference is available as prior art to the present invention.

I claim:

1. A process for applying a wax to a mesh of a lacrosse stick comprising:

(a) dipping the mesh into molten wax to obtain a wax coated mesh;

(b) providing a heat conductive layer having a first side and a second opposed side and positioning the first side in contact with the wax coated mesh; and, (c) applying heat and pressure to the second side of the heat conductive layer to obtain a wax impregnated mesh.

2. The process of claim 1, wherein the mesh is heated by applying a heated surface to the second opposed side of the heat conductive layer.

3. The process of claim 1, wherein the mesh comprises a plurality of strands, each strand comprising a plurality of elongate members, and sufficient heat is provided such that the wax flows between the elongate members.

4. A process for applying a wax to a mesh of a lacrosse stick comprising:

(a) providing a formed mesh;

(b) dipping the mesh into molten wax to obtain a wax coated mesh: and, (c) applying pressure and heat directly to the wax coated mesh to obtain a wax impregnated mesh.

5. The process of claim 4 further comprising attaching the wax impregnated mesh to the lacrosse stick.

6. The process of claim 4, wherein the mesh comprises a plurality of strands, each strand comprising a plurality of elongate members, and sufficient heat is provided such that the wax flows between the elongate members.

7. The process of claim 4 further comprising applying a heated surface directly on the wax coated mesh.

* * * * *